US010688549B2

(12) United States Patent
Perrot et al.

(10) Patent No.: US 10,688,549 B2
(45) Date of Patent: Jun. 23, 2020

(54) FOLDING DEVICE FOR SIMULTANEOUS FORMATION OF A PLURALITY OF CORRUGATIONS IN A METAL SHEET AND METHOD FOR USE OF SAID DEVICE

(71) Applicant: GAZTRANSPORT ET TECHNIGAZ, Saint Remy les Chevreuse (FR)

(72) Inventors: Olivier Perrot, Etampes (FR); Charles Gimbert, Boulogne-Billancourt (FR); Thomas Conejero, Guyancourt (FR); Mohamed Sassi, Meudon-la-Foret (FR)

(73) Assignee: GAZTRANSPORT ET TECHNIGAZ, Saint Remy Les Chevreuse (FR)

( * ) Notice: Subject to any disclaimer, the term of this patent is extended or adjusted under 35 U.S.C. 154(b) by 543 days.

(21) Appl. No.: 15/506,278

(22) PCT Filed: May 15, 2015

(86) PCT No.: PCT/FR2015/051277
§ 371 (c)(1),
(2) Date: Feb. 24, 2017

(87) PCT Pub. No.: WO2016/034782
PCT Pub. Date: Mar. 10, 2016

(65) Prior Publication Data

US 2017/0252790 A1 Sep. 7, 2017

(30) Foreign Application Priority Data

Sep. 2, 2014 (FR) ..... 14 58189
Apr. 3, 2015 (WO) ..... PCT/FR2015/050872

(51) Int. Cl.
*B21D 13/02* (2006.01)
*B21D 13/10* (2006.01)
*B21D 5/04* (2006.01)

(52) U.S. Cl.
CPC ..... *B21D 13/02* (2013.01); *B21D 13/10* (2013.01); *B21D 5/04* (2013.01)

(58) Field of Classification Search
CPC ..... B21D 11/07; B21D 13/00; B21D 13/02; B21D 13/10
See application file for complete search history.

(56) References Cited

U.S. PATENT DOCUMENTS 4,635,462 A * 1/1987 Bald ..... B21D 13/02 72/385
5,200,013 A * 4/1993 Traber ..... B21D 13/02 156/210

(Continued)

FOREIGN PATENT DOCUMENTS

JP H057941 A 1/1993
KR 100766309 B1 10/2007

(Continued)

OTHER PUBLICATIONS

International Search Report with regard to PCT/FR2015/051277 dated Sep. 10, 2015.
English Abstract of JPH057941 retrieved on Espacenet on Feb. 22, 2017.

(Continued)

*Primary Examiner* — Pradeep C Battula
(74) *Attorney, Agent, or Firm* — Blank Rome LLP

(57) ABSTRACT

The invention relates to a bending device for forming corrugations in a metal sheet including:
- a lower frame;
  - an upper frame able to move vertically between a rest position and a bending position;
  - at least two dies, carried by the lower frame; one being fixed with respect to the lower frame and the other mounted with the ability to slide;
  - at least two punches carried by the upper frame; one being fixed and the other being mounted with the ability to slide on the upper frame;

(Continued)

the bending device being designed so that, in operation, as the upper frame moves towards its bending position, the metal sheet transmits a pulling force to the sliding punch and to the sliding die which force moves them from a spaced-apart position toward a close-together position.

15 Claims, 6 Drawing Sheets

(56) References Cited

U.S. PATENT DOCUMENTS

| | | | | |
|---|---|---|---|---|
| 8,950,231 | B2 * | 2/2015 | Sukup | B21D 13/00 72/385 |
| 2004/0093927 | A1 * | 5/2004 | Leon | B21D 13/02 72/385 |

FOREIGN PATENT DOCUMENTS

| | | | |
|---|---|---|---|
| KR | 20080090107 | A | 10/2008 |
| KR | 101322977 | B1 | 10/2013 |
| WO | 2014116103 | A1 | 7/2014 |

OTHER PUBLICATIONS

English Abstract of KR101322977 retrieved on Espacenet on Feb. 22, 2017.

English Abstract of KR20080090107 retrieved on Espacenet on Feb. 22, 2017.

* cited by examiner

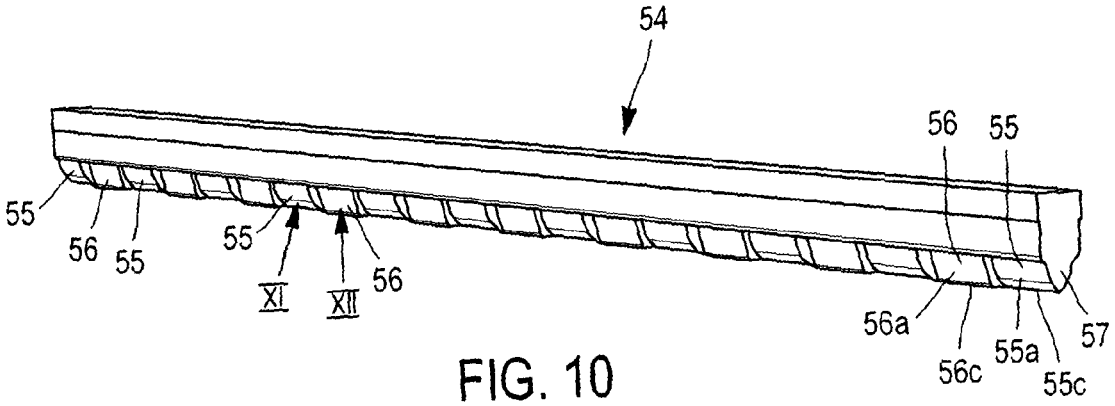
FIG. 10
FIG. 11
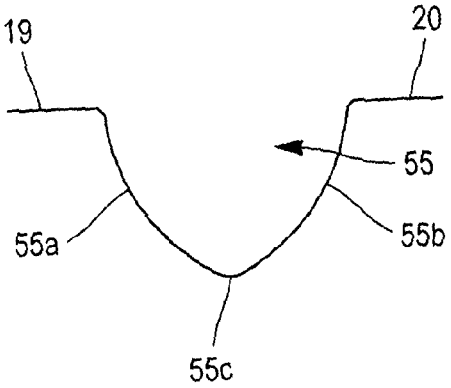
FIG. 12
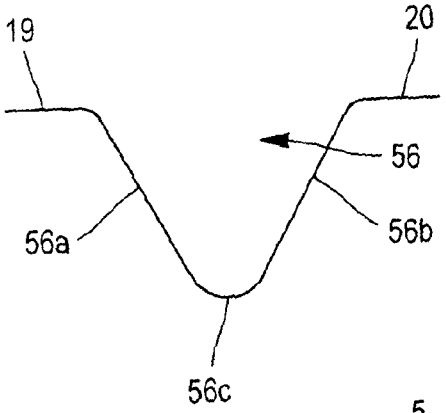
FIG. 13
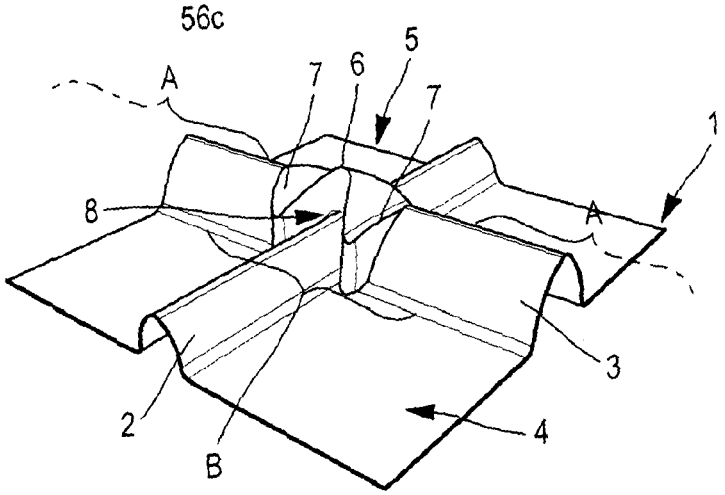

FOLDING DEVICE FOR SIMULTANEOUS FORMATION OF A PLURALITY OF CORRUGATIONS IN A METAL SHEET AND METHOD FOR USE OF SAID DEVICE

CROSS-REFERENCE

The present application is a National Stage Entry of International Patent Application No. PCT/FR2015/051277 filed on May 15, 2015 and claims priority of the French Patent Application No. 1458189 filed on Sep. 2, 2014 and of the International Patent Application No. PCT/FR2015/050872 filed on Apr. 3, 2015 the entire contents of which are incorporated herein by reference.

TECHNICAL FIELD

The invention relates to a bending device for forming a plurality of corrugations in a metal sheet and to a method of using the device.

The invention relates more particularly to the field of sealed and thermally insulating membrane-type tanks for storing and/or transporting fluid such as cryogenic fluid; a corrugated metal sheet, obtained by means of the bending device according to the invention, being notably intended for the construction of a sealed membrane of such a tank.

TECHNICAL BACKGROUND

In the prior art, corrugated sealing membranes intended to form an internal coating for liquefied natural gas storage tanks are known. The sealing membrane is made up of a plurality of metal plates having perpendicular series of corrugations allowing it to deform under the effect of the thermal and mechanical stresses generated by the fluid stored in the tank.

Such a corrugated sealing membrane is described for example in document KR100766309. The corrugated membrane comprises a first series of parallel corrugations, referred to as tall corrugations, extending in a first direction and a second series of parallel corrugations, referred to as low corrugations, extending in a second direction perpendicular to the first.

In order to create such a sealing membrane the tall corrugations are formed first of all and then the low corrugations and the node zones between the low and tall corrugations are then formed.

The aforementioned document KR100766309 provides for the tall corrugations to be created by means of a bending device comprising a lower frame and an upper frame mounted with the ability to move vertically with respect to the lower frame between a rest position and a bending position. The lower frame supports a die made up of two die elements each having a half-cavity, these being able to move between a spaced-apart position and a close-together position one against the other in which the half-cavities of the two die elements together define a cavity corresponding to the shape of the corrugation that is to be formed. Moreover, the upper frame carries a punch intended to engage inside the cavity so as to form the corrugation, when the upper frame is in its bending position, and two clamps extending one on each side of the punch and collaborating respectively with each of the die elements when the upper frame moves toward its bending position so as to hold the metal sheet against the die elements so that the metal sheet remains in position as it is being bent.

During a bending operation, the two die elements move closer together at the same time as the punch moves toward its bending position. Thus, such a bending device makes it possible to ensure that the bending operation does not alter the thickness of the metal sheet, notably at the corrugation. This is because it is absolutely essential for the metal sheet after bending to have a thickness that is constant so as not to impair its mechanical properties.

However, such a bending device allows only one corrugation to be made at a time. Thus, in order to create a plurality of corrugations in the metal sheet, one stroke of the press needs to be performed for each corrugation and the metal sheet needs to be moved between each stroke of the press. Thus, the operations for creating a plurality of corrugations in one and the same metal sheet are lengthy and complex to implement.

SUMMARY

One idea behind the invention is that of proposing a bending device that is simple and makes it possible to form several corrugations simultaneously in a metal sheet without altering the thickness of the sheet.

According to one embodiment, the invention provides a bending device for simultaneously forming at least two parallel corrugations in a metal sheet, the bending device comprising:

- a lower frame;
- an upper frame mounted with the ability to move vertically with respect to the lower frame between a rest position and a bending position;
- at least a first and a second dies borne by the lower frame and each comprising a cavity parallel to the cavity of the other die and corresponding to the shape of one of the corrugations that is to be formed; the first die being fixed with respect to the lower frame and the second die being mounted with the ability to slide on the lower frame in a direction transverse to the direction of the corrugations that are to be formed, between a spaced-apart position and a close-together position with respect to the first die; said second die being returned towards its spaced-apart position by a return member;
- at least a first and a second punches which are parallel and carried by the upper frame respectively above the first and above the second dies, the first punch being fixed with respect to the upper frame and intended to engage inside the cavity of the first die when the upper frame moves from its rest position towards its bending position so as to press the metal sheet, and the second punch being mounted with the ability to slide on the upper frame in a direction transverse to the direction of the corrugations that are to be formed, between a spaced-apart position and a close-together position with respect to the first punch and being intended to engage inside the cavity of the second die when the upper frame moves towards its bending position so as to press the metal sheet, said second punch being returned towards its spaced-apart position by a return member;
- the bending device being designed in such a way that, in operation, the movement of the upper frame towards its bending position is able to cause the metal sheet to be bent between the first punch and the first die, on the one hand, and between the second punch and the second die on the other hand, so that said metal sheet transmits a pulling force to the second punch and to the second die which moves them from their spaced-apart position toward their close-together position.

Thus, such a bending device allows the simultaneous creation of several parallel corrugations without altering the thickness of the metal sheet.

Furthermore, the bending device is relatively simple.

According to some embodiments, such a bending device may comprise one or more of the following features:

the first and second dies each comprise two lateral elements and a central element; the lateral elements each comprising a lateral portion of the cavity of said first or second die and the central element comprising a central portion of the cavity of said first or second die, the central element being mounted with the ability to move vertically, between the lateral elements, between a raised position and a lowered position and being returned toward its raised position by a return member such that, in operation, the movement of the upper frame from its rest position toward its bending position is able to grip the metal sheet between each of the first and second punches and the central element of the corresponding first or second die and to move the central element from its raised position to its lowered position;

the return member for the central element is a gas spring or a helical spring;

the lateral elements of the first and second dies each comprise a horizontal upper bearing surface which is intended to receive the metal sheet and the first and second punches each have a head comprising a V-shaped portion of a shape that complements that of the cavity of the first or of the second die and two shoulders bordering the V-shaped portion, extending out horizontally and each coming to face the horizontal upper bearing surface of one of the lateral elements of the first or of the second die;

the bending device comprises:

a first lower clamp, mounted on the lower frame between the first and the second dies and having a bearing surface intended to receive the metal sheet; the first lower clamp being mounted with the ability to slide on the lower frame in a direction transverse to the direction of the corrugations that are to be formed between a spaced-apart position and a close-together position with respect to the first die, the first lower clamp being returned towards its spaced-apart position by a return member;

a first upper clamp, mounted on the upper frame between the first and second punches above the first lower clamp so as to allow the metal sheet to be clamped between the first upper clamp and the first lower clamp as the upper frame moves from its rest position towards its bending position, the first upper clamp being mounted with the ability to slide on the upper frame in a direction transverse to the direction of the corrugations that are to be formed between a spaced-apart position and a close-together position with respect to the first punch, and returned towards its spaced-apart position by a return member;

the bending device being arranged in such a way that, in operation, the movement of the upper frame from its rest position into its bending position is able to cause the metal sheet to be bent between the first punch and the first die in such a way that said metal sheet transmits a pulling force to the first upper clamp and to the first lower clamp, which moves them from their spaced-apart position toward their close-together position;

the first upper clamp is mounted with the ability to move vertically on a support mounted with the ability to slide on the upper frame in the direction transverse to the direction of the corrugations that are to be formed and the first upper clamp is returned to a distance away from said support by a series of return members;

the first upper clamp is mounted with the ability to slide vertically on the associated support via guide tubes borne by the first upper clamp and sliding in bores formed in the support;

the return member returning the first upper clamp to some distance away from the support is a gas spring or a helical spring;

the bending device further comprises:

a third die comprising a cavity corresponding to the shape of one of the corrugations that is to be formed, parallel to the cavities of the first and second dies; the first die being arranged between the second and the third dies, the third die being mounted with the ability to slide on the lower frame in a direction transverse to the direction of the corrugations that are to be formed between a spaced-apart position and a close-together position with respect to the first die, said third die being returned to its spaced-apart position by a return member; and a third punch, parallel to the first and second punches borne by the upper frame above the third die; the third die being intended to engage inside the third die when the upper frame is moving from its rest position into its bending position and being mounted with the ability to slide on the upper frame transversely to the direction of the corrugations to be formed between a spaced-apart position and a close-together position with respect to the first punch, said third punch being returned to its spaced-apart position by a return member;

the bending device further comprises:

a second lower clamp, mounted on the lower frame between the first and third dies and having a bearing surface intended to accept the metal sheet; the second lower clamp being mounted with the ability to slide on the lower frame in a direction transverse to the direction of the corrugations that are to be formed between a spaced-apart position and a close-together position with respect to the first die, the second lower clamp being returned towards its spaced-apart position by a return member;

a second upper clamp, mounted on the upper frame between the first and the third punches above the second lower clamp, so as to clamp the metal sheet between the second upper clamp and the second lower clamp during the movement of the upper frame from its rest position towards its bending position, the second upper clamp being mounted with the ability to slide on the upper frame in a direction transverse to the direction of the corrugations that are to be formed between a spaced-apart position and a close-together position with respect to the first punch and returned towards its spaced-apart position by a return member;

the bending device being designed in such a way that, in operation, the movement of the upper frame from its rest position toward its bending position is able to cause the metal sheet to be bent between the first punch and the first die in such a way that said metal sheet transmits a pulling force to the second upper clamp and to the second lower clamp which moves them from their spaced-apart position toward their close-together position;

according to one embodiment, the bending device further comprises assistance means assisting with the movement of the second die and of the second punch towards their close-together position. According to another embodiment, the bending device does not require special purpose actuating means for causing the second punch and the second die to move;

according to one embodiment, the assistance means comprise an actuating cylinder cooperating with the second die or with the second punch and being designed to assist with the moving of the second die and of the second punch toward their close-together position as the upper frame moves from its rest position toward its bending position;

according to another embodiment, the assistance means comprise a cam follower and a cam, of the cam follower and the cam one being borne by the second die or the second punch and the other being borne by the upper frame or the lower frame such that when the upper frame moves from its rest position to its bending position the cam follower collaborates with the cam to assist with the movement of the second die and of the second punch toward their close-together position;

each of the first and second punches comprises a head comprising first and second portions of V-shaped cross section, the first and second portions being arranged alternately one after another in the longitudinal direction of the corrugation that is to be formed, each of the first and second portions comprising two side walls meeting at a crest zone so as to define the V-shaped cross section; the lateral faces of the first portions being bowed with a convex face facing toward the first or the second die and the lateral faces of the second portions being planar. The first and second portions may be arranged directly one after another or may be separated by a longitudinal transition portion;

the crest zone of the second portions of the head projects downward beyond the crest zone of the first portions of the head;

the head comprises at each of its two longitudinal ends a first portion;

the first portions of the head have a substantially semielliptical shape;

the second portions of the head have a triangular shape;

according to one embodiment, each second portion of the head is separated from the adjacent first portions by a longitudinal transition portion. Such a longitudinal transition portion makes it possible to avoid an abrupt change in shape of the corrugation that could weaken the metal sheet;

according to one embodiment, each longitudinal transition portion is made up of a free longitudinal space, which means to say an empty space in which the head has no surface liable to come into contact with the metal sheet during the bending operation;

according to another embodiment, each longitudinal transition portion comprises a V-shaped cross section and comprises two lateral faces that meet at a crest zone, the lateral faces and the crest zone being inclined with respect to the longitudinal direction and joining the lateral faces and the crest zones of the adjacent second portion and first portion. Thus, the longitudinal transition portions ensure a progressive transition between the first portions and the second portions;

the first die comprises first and second V-shaped portions arranged alternately one after another and respectively having a shape that complements the shape of the first and second portions of the first punch; the first portions of the first punch being intended to engage inside the first portions of the first die and the second portions of the first punch being intended to engage inside the second portions of the first die. The first and second portions of the first die may be arranged directly one after another or may be separated by a longitudinal transition portion;

when the first die is equipped with a longitudinal transition portion, its length is substantially equal to that of the longitudinal portion of the head of the first punch.

According to one embodiment, the invention also provides a method of using an aforementioned bending device, the use involving:

positioning a metal sheet against the first and second dies; and moving the upper frame from its rest position toward its bending position.

Such a method of using the bending device may notably be aimed at simultaneously forming at least two parallel corrugations in a metal sheet.

According to another embodiment, the invention relates to a bending device for forming a corrugation in a metal sheet, the bending device comprising:

a lower frame;

an upper frame mounted with the ability to move vertically with respect to the lower frame between a rest position and a bending position;

a die, carried by the lower frame and comprising a cavity corresponding to the shape of the corrugation that is to be formed;

a punch carried by the upper frame above the die, the punch being intended to engage inside the cavity of the die when the upper frame moves from its rest position to its bending position so as to press the metal sheet in which the die comprises two lateral elements and a central element; the lateral elements each comprising a lateral portion of the cavity of the die and the central element comprising a central portion of the cavity of the die, the central element being mounted with the ability to move vertically, between the lateral elements, between a raised position and a lowered position and being returned toward its raised position by a return member so that, in operation, the movement of the upper frame from its rest position toward its bending position is able to grip the metal sheet between the punch and the central element of the die and to move the central element from its raised position toward its lowered position.

According to another embodiment, the invention relates to a bending device for forming at least one corrugation in a metal sheet, the bending device comprising:

a lower frame;

an upper frame mounted with the ability to move vertically with respect to the lower frame between a rest position and a bending position;

at least one first die, carried by the lower frame and comprising a cavity corresponding to the shape of the corrugation that is to be formed;

at least a first punch carried by the upper frame above the first die and intended to engage inside the cavity of the first die when the upper frame moves from its rest position to its bending position so as to press the metal sheet; the first punch comprising a head comprising first and second portions of V-shaped cross section, the first and second portions being arranged alternately one after another in the longitudinal direction of the corrugation that is to be formed, each of the first and second portions comprising two side walls meeting at a crest zone so as to define the V-shaped cross section; the lateral faces of the first portions being bowed with a convex face facing towards the first die and the lateral faces of the second portions being planar.

BRIEF DESCRIPTION OF THE FIGURES

The invention will be better understood and further objects, details, features and advantages thereof will become more clearly apparent during the course of the following description of a number of particular embodiments of the invention, which are given solely by way of nonlimiting example and with reference to the attached drawings.

FIG. 10 is a perspective view of a punch according to an alternative form of embodiment.

FIG. 11 schematically illustrates the cross section of the punch in zone XI of FIG. 10.

FIG. 12 schematically illustrates the cross section of the punch in zone XII of FIG. 10.

FIG. 13 is a detailed view of a corrugated metal sheet at an intersection between a tall corrugation and a low corrugation.

DETAILED DESCRIPTION OF EMBODIMENTS

Figure 1:
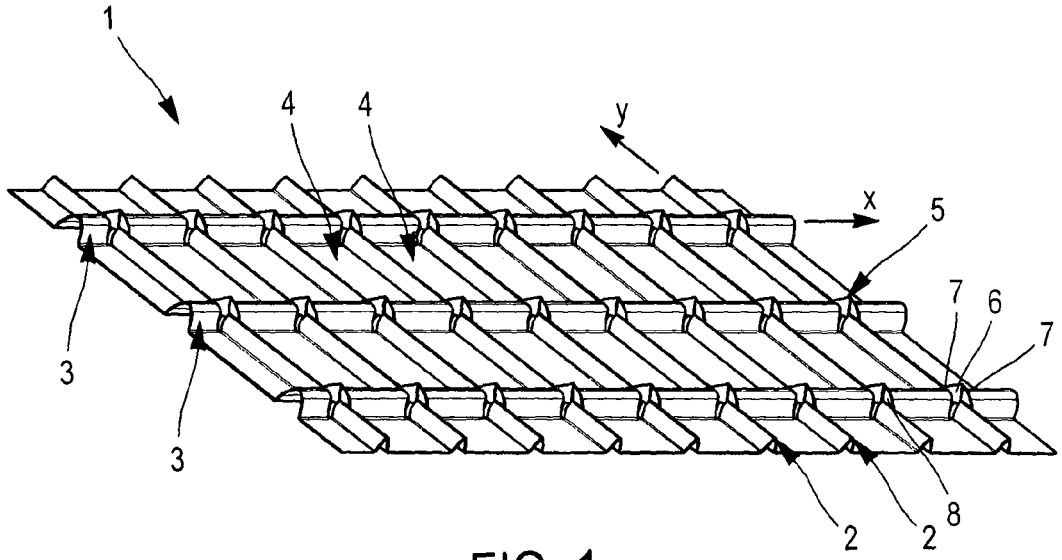
FIG. 1 is a view of a corrugated metal sheet intended for the construction of a sealed membrane of a liquefied natural gas storage tank.
Figure 2:
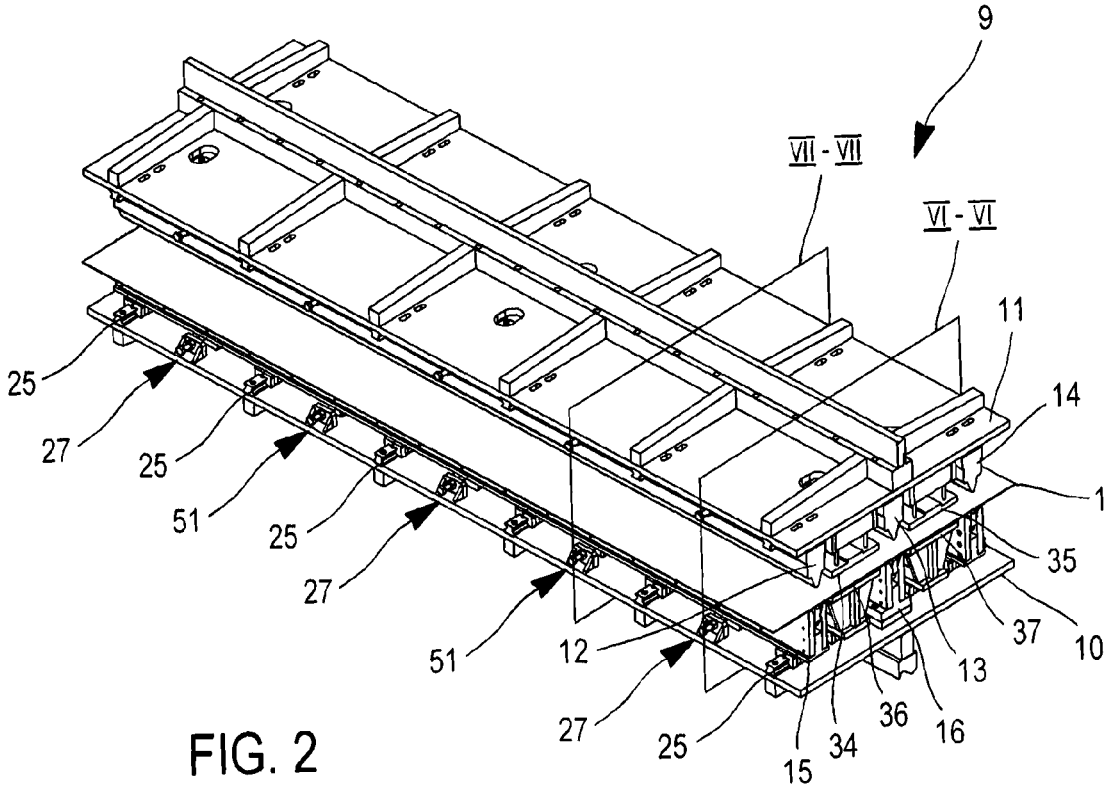
FIG. 2 is a perspective view of a bending device for forming three parallel corrugations in a metal sheet.

FIG. 1 illustrates a corrugated metal sheet 1 intended for the formation of a sealed membrane of a tank for storing a cryogenic fluid such as a liquefied natural gas.

The metal sheet 1 comprises a first series of parallel corrugations 2, referred to as low corrugations, extending in a direction y and a second series of parallel corrugations 3, referred to as tall corrugations, extending in a direction x. The directions x and y of the series of corrugations are perpendicular. The corrugations 2, 3 project on the side of the internal face of the metal sheet 1, which is the face intended to be brought into contact with the fluid contained in the tank. The edges of the metal sheet 1 here are parallel to the corrugations 2, 3. Note that the terms "tall" and "low" have a relative meaning and mean that the corrugations 2 referred to as low corrugations are smaller in height than the corrugations 3 referred to as tall corrugations.

The metal sheet 1 comprises, between the corrugations 2, 3, a plurality of planar surfaces 4. At each intersection between a low corrugation 2 and a tall corrugation 3, the metal sheet 1 comprises a node zone 5. The node zone 5 comprises a central portion 6 having a summit projecting toward the inside of the tank. Moreover, the central portion 6 is bordered, on the one hand, by a pair of concave corrugations 7 formed in the crest of the tall corrugation 3 and, on the other hand, by a pair of indentations 8 that the low corrugation 2 penetrates.

The corrugations 2, 3 of the metal sheet 1 allow the sealing membrane to be flexible so that it can deform under the effect of the thermal and mechanical stress loadings generated by the liquefied natural gas stored in the tank.

The metal sheet 1 may notably be made of stainless steel, of aluminum, of Invar®: namely an alloy of iron and nickel with an expansion coefficient typically of between $1.2.10^{-6}$ and $2.10^{-6}\ K^{-1}$, or from an iron alloy with a high manganese content, the expansion coefficient of which is typically of the order of $7.10^{-6}\ K^{-1}$. However, the use of other metals or alloys is also conceivable.

By way of example, the metal sheet 1 has a thickness of around 1.2 mm. Other thicknesses are also conceivable, in the knowledge that a thickening of the metal sheet 1 leads to an increase in its cost and generally increases the stiffness of the corrugations 2, 3.

FIGS. 2 to 9 depict a bending device 9 allowing several tall corrugations 3 to be formed simultaneously in such a metal sheet 1 prior to the formation of the low corrugations 2. By convention, the "longitudinal" orientation of the bending device 9 is directed parallel to the longitudinal directions of the corrugations 3 that are to be formed and the "transverse" orientation is directed transversely to the longitudinal directions of the corrugations 3 that are to be formed.

The bending device 9 comprises a lower frame 10 and an upper frame 11 mounted with the ability to move vertically with respect to the lower frame 10. The upper frame 11 is able to move, with respect to the lower frame 10, between a raised rest position and a position for bending the metal sheet 1 in which position this sheet is deformed to form the corrugations 3. The upper frame 11 is thus able to apply to the metal sheet 1 a pressure that allows it to be bent and that allows the formation of the corrugations 3. The upper frame 11 is illustrated, in its rest position, in FIG. 3 and, in its bending position at the end of travel, in FIG. 9. The upper frame 11 is also depicted, in FIG. 8, in an intermediate position just before the formation of the corrugations 3 begins.

Figure 3:
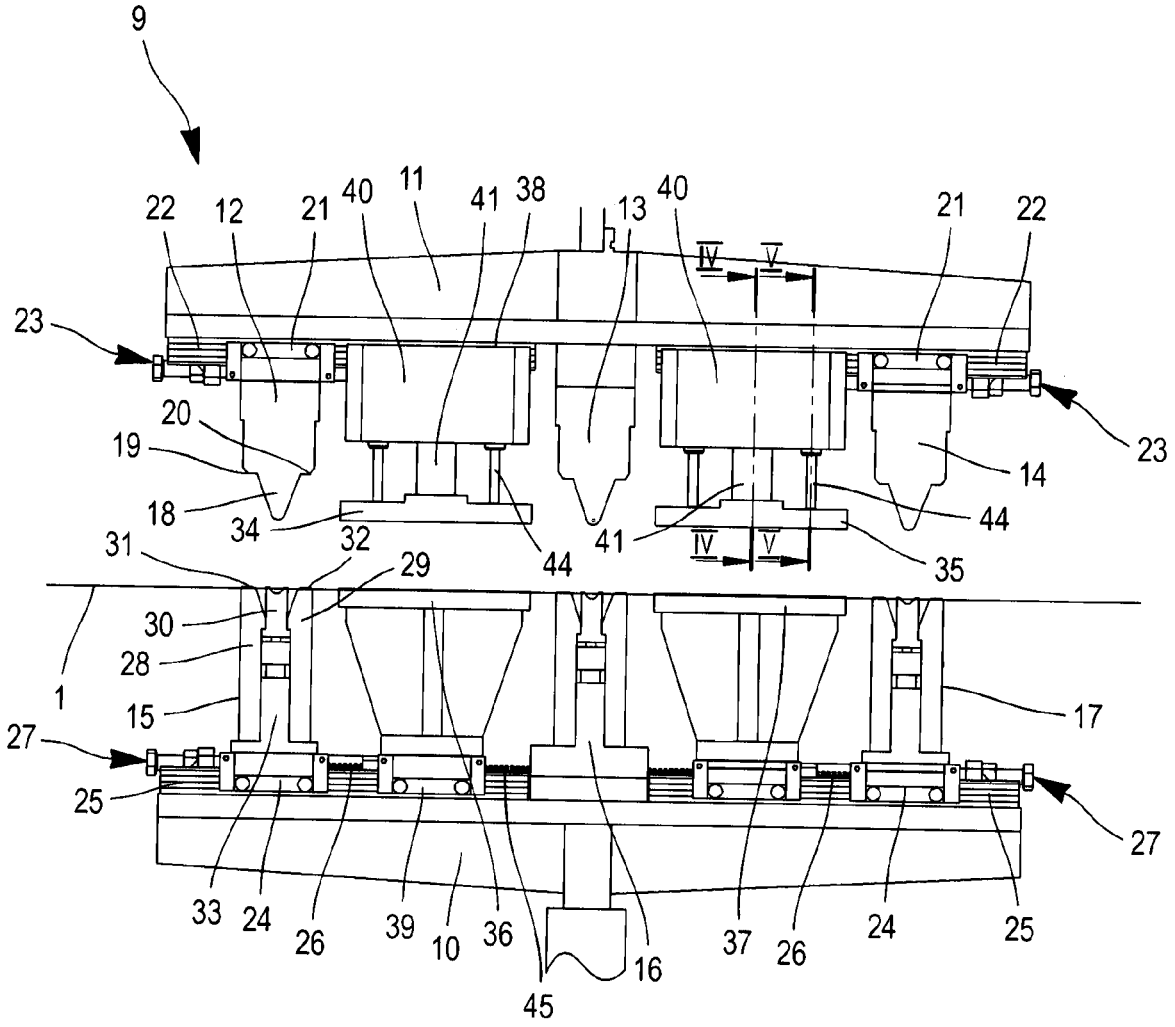
FIG. 3 is a front view of the bending device, in a raised position of rest.
Figure 8:
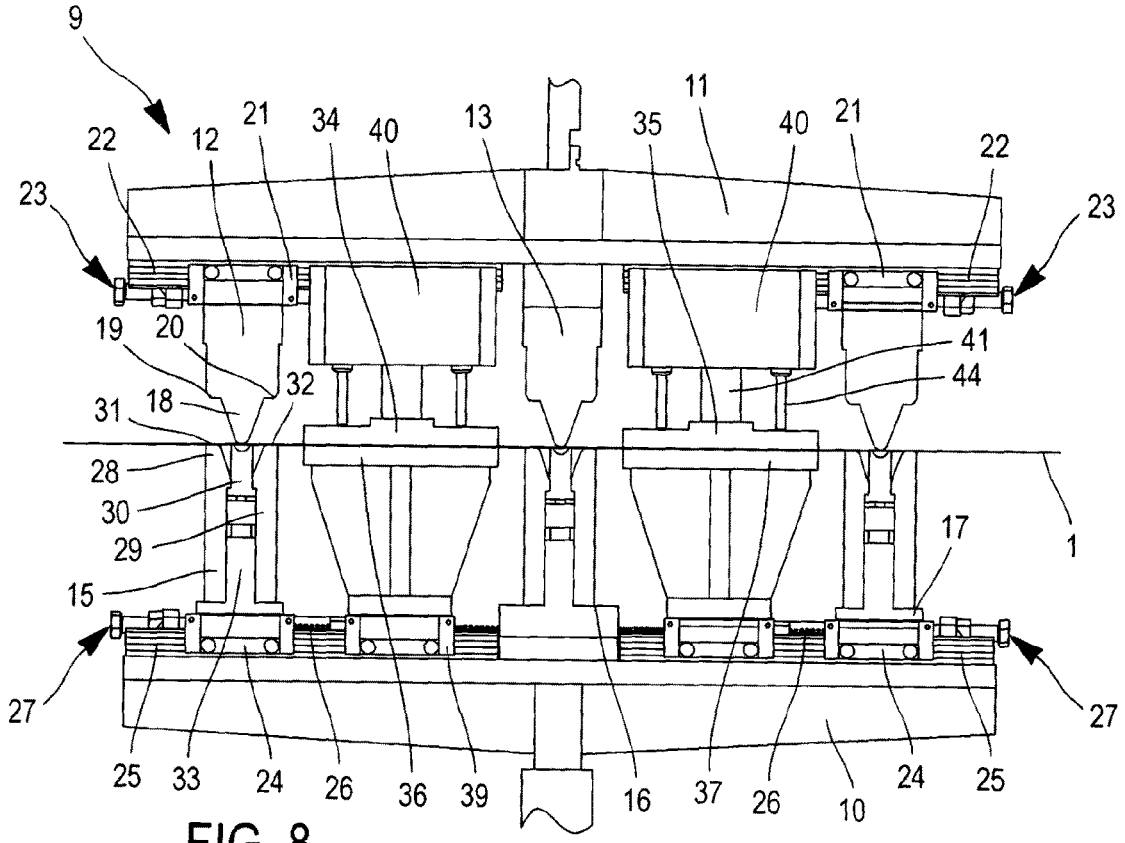
FIG. 8 is a front view of the bending device in an intermediate position of contact with the metal sheet.
Figure 9:
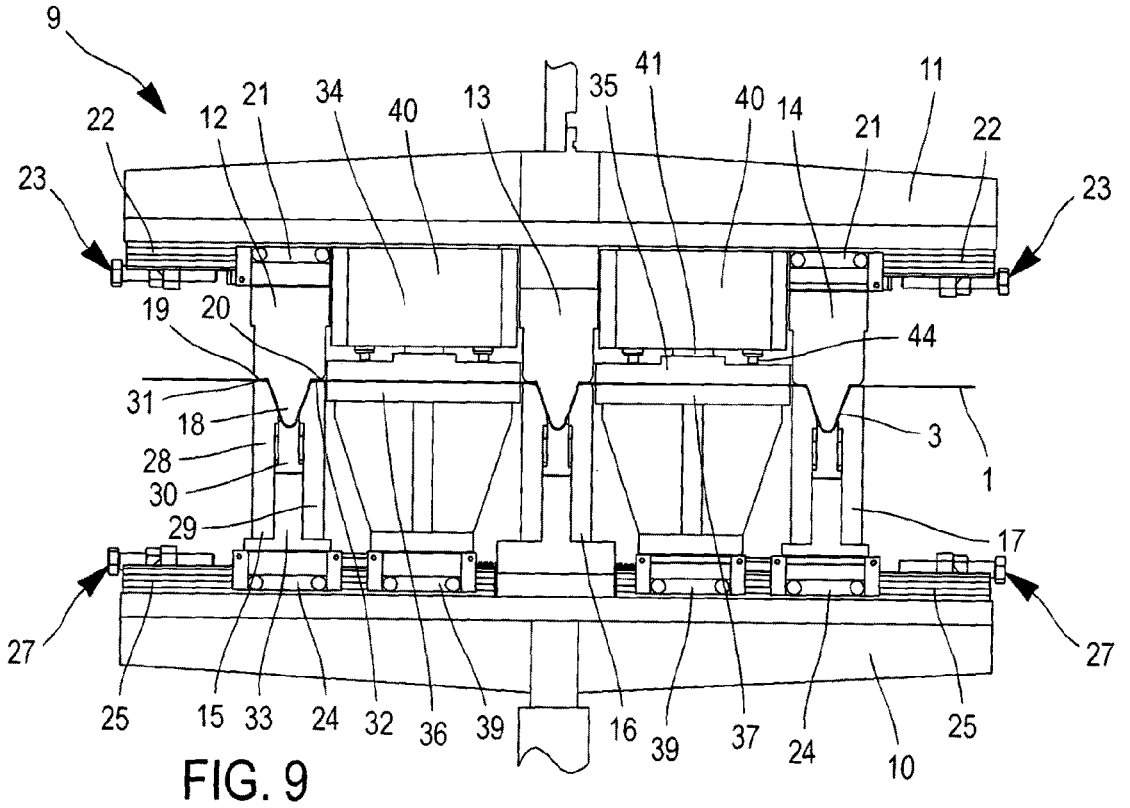
FIG. 9 is a front view of the bending device in a position of bending of the metal sheet, at the end of travel.

In relation to FIGS. 3, 8 and 9, it may be seen that the bending device 9 comprises three punches 12, 13, 14 extending parallel to one another, carried by the upper frame 11. Each punch 12, 13, 14 is arranged above a respective die 15, 16, 17, carried by the lower frame 10. Each punch 12, 13, 14 is intended to engage inside the cavity of its respective die 15, 16, 17 when the upper frame 11 moves from its rest position towards its bending position, so as to press the metal sheet 1 between the punch 12, 13, 14 and its respective die 15, 16, 17 and thus form the corrugations 3 in the metal sheet 1.

Each punch 12, 13, 14 comprises, at its lower end, a head 18 having a shape that corresponds to the shape of the corrugation that is to be fashioned. The head 18 comprises a portion the cross section of which is V-shaped. Moreover, the head 18 also comprises two lateral shoulders 19, 20 bordering the V-shaped cross section and extending out horizontally. The head 18 extends over a length substantially equal to the longitudinal dimension of the metal sheet 1 that is to be bent.

The central punch 13 is fixed with respect to the upper frame 11. The lateral punches 12, 14, arranged one on each side of said central punch 13, are themselves mounted with the ability to slide on the upper frame 11 in a transverse horizontal direction. The lateral punches 12, 14 are mounted with the ability to move on the upper frame 11 between a spaced-apart position and a close-together position in relation to the central punch 13. In order to do that, the lateral punches 12, 14 are each equipped with one or more carriages 21 each of which is mounted on an associated guide rail 22 supported by the upper frame 11. The carriages 21 are advantageously rolling carriages which comprise a plurality of rolling bodies able to collaborate with runway tracks carried by the associated guide rail 22.

Return members, not depicted, ensure that the lateral punches 12, 14 return toward their spaced-apart position spaced apart from the central punch 13. Moreover, the upper frame 11 is equipped with end-stop elements 23 making it possible to limit the travel of the lateral punches 12, 14 with respect to the central punch 13 and thus making it possible to define the spaced-apart positions of the lateral punches 12, 14 with respect to the upper frame 11. These end-stop elements 23 will be described in greater detail later on.

Moreover, the three dies 15, 16, 17 carried by the lower frame are each able to define a cavity having a shape that complements their respective punch 12, 13, 14. One of the dies: the central die 16, is fixed with respect to the lower frame 10. The lateral dies 15, 17, which are arranged one on each side of the central die 16 are themselves mounted with the ability to slide on the lower frame 10 in a transverse horizontal direction. The lateral dies 15, 17 are thus mounted with the ability to slide on the lower frame 10 between a spaced-apart position and a close-together position with respect to the central die 16. To do that, the lateral dies 15, 17 are equipped with one or more carriages 24 each of which is mounted on an associated guide rail 25 carried by the lower frame 10. The carriages 24 are advantageously rolling carriages, as mentioned hereinabove. The lateral dies 15, 17 each collaborate with return members 26 which will be described in detail later on, allowing the lateral dies 15, 17 to be returned to their spaced-apart position. Furthermore, the lower frame is equipped with end-stop elements 27 making it possible to limit the travel of the lateral dies 15, 17 with respect to the central die 16 and thus making it possible to define their spaced-apart position in relation to the lower frame 10.

Each of the dies 15, 16, 17 comprises two lateral elements 28, 29 and a central element 30 mounted with the ability to slide between the lateral elements 28, 29, between a raised position, illustrated in FIG. 3, and a lowered position, illustrated in FIG. 9. The lateral elements 28, 29 each define a lateral portion of the cavity. The lateral elements 28, 29 further comprise a horizontal upper bearing surface 31, 32, flanking the cavity, arranged facing the lateral shoulders 19, 20 of the head 18 of the punch 12, 13, 14 facing it. The central element 30 carries a central portion of the cavity. The central element 30 is returned towards its raised position by a return member. The return member is, for example, a gas spring or cylinder 33 or helical spring housed between the lateral elements 28, 29.

When the central element 30 is in its raised position depicted in FIGS. 3 and 8, its upper end lies flush with the horizontal upper bearing surfaces 31, 32 of the lateral elements 28, 29. When the central element 30 is in its lowered position depicted in FIG. 9, the lateral elements 28, 29 and the central element 30 together define a cavity having a shape that complements that of the head 18 of the corresponding punch 12, 13, 14. Also, during bending, the head 18 of each punch 12, 13, 14 engages between the lateral elements 28, 29 of the die 15, 16, 17 facing them and presses the metal sheet 1 firmly against the central element 30 of said die 15, 16, 17 so as to move the central element 30 into its lowered position as the upper frame 11 moves toward its bending position.

Moreover, the bending device 9 is equipped with clamps 34, 35, 36, 37 that allow the metal sheet 1 to be held so as to ensure that it remains in position as it is being bent. The bending device 9 comprises two lower clamps 36, 37 mounted on the lower frame 10 and two upper clamps 34, 35 mounted on the upper frame 11. The two lower clamps 36, 37 are arranged one on each side of the central die 16, and are each positioned between said central die 16 and one of the two lateral dies 15, 17.

The two upper clamps 34, 35 are respectively arranged above each of said lower clamps 36, 37. The two upper clamps thus extend one on each side of the central punch 13 and are each positioned between the central punch 13 and one of the lateral punches 12, 14. The lower clamps 36, 37 comprise a planar bearing surface intended to accept the metal sheet 1. The upper clamps 34, 35 each have a planar clamping surface designed so that when the upper frame 11 is moved toward its bending position, the metal sheet 1 is sandwiched between the planar bearing surfaces of the lower clamps 36, 37 and the clamping surfaces of the upper clamps 34, 35, so as to hold the metal sheet 1 in position.

The upper clamps 34, 35 are mounted with the ability to slide on the upper frame 11 in the transverse horizontal direction between a spaced-apart position and a close-together position in relation to the central punch 13. Similarly, the lower clamps 36, 37 are mounted with the ability to slide on the lower frame 10 in a transverse horizontal direction between a spaced-apart position and a close-together position in relation to the central die 16. To do that, the clamps 34, 35, 36, 37 are mounted with the ability to slide by means of one or more carriages 38, 39 which are mounted with the ability to slide on an associated guide rail 22, 25. The guide rails 22 of the upper clamps 34, 35 are fixed to the upper frame 11, whereas the guide rails 25 of the lower clamps 36, 37 are fixed to the lower frame 10. In the embodiment depicted, in order to limit the number of guide rails, guide rails shared in common 22, 25 guide both a lateral punch 12, 14 or a lateral die 15, 17 and an upper 34, 35 or lower 36, 37 clamp.

The bending device 9 is equipped with return members 45 allowing the lower clamps 36, 37 to be returned toward their spaced-apart position and with return members, not depicted, allowing the upper clamps 34, 35 to be returned to their spaced-apart position.

The upper clamps 34, 35 are each mounted with the ability to slide on the upper frame 11 via a support 40 equipped with one or more carriages 38 mounted with the ability to slide on one or more guide rails 22 carried by the upper frame 11.

Figure 4:
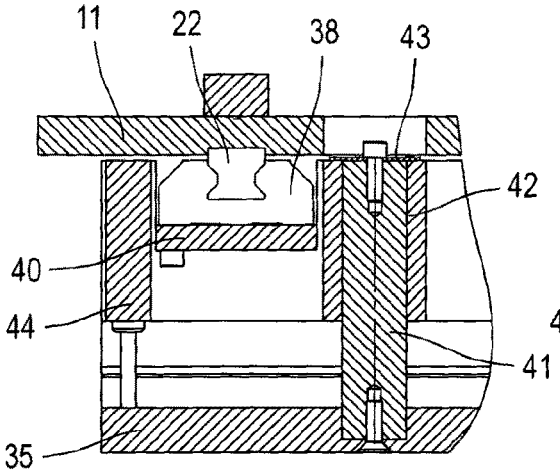
FIG. 4 is a view of an upper clamp and of its support, in section on IV-IV illustrated in FIG. 3.

As depicted in FIG. 4, each upper clamp 34, 35 is mounted with the ability to slide vertically on a support 40 via a guide device comprising a plurality of guide tubes 41 secured to said upper clamp 35 and mounted with the ability to slide in bores 42 formed in the support 40. The guide tubes 41 comprise a first end which is fixed to the upper clamp 35 and a second end fixed to a retaining plate 43 that is larger in dimension than the diameter of the bore 42 formed in the support 40, so as to hold the upper clamp 35 with respect to its support 40.

Figure 5:
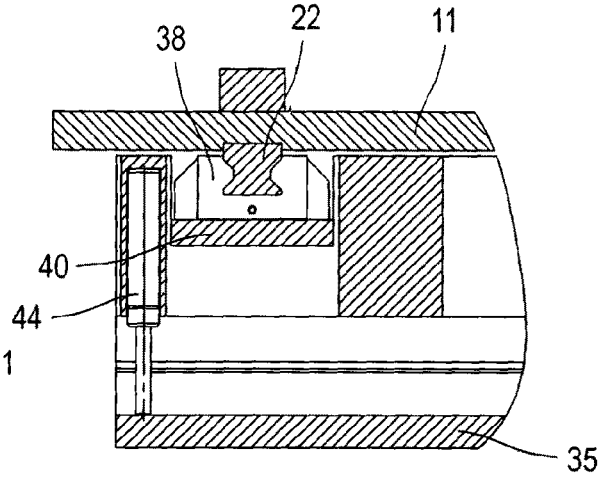
FIG. 5 is a view of an upper clamp and of its support, in section on V-V illustrated in FIG. 3.

Moreover, one or more return members apply an elastic force between each upper clamp 34, 35 and the associated support 40, tending to push the upper clamp 34, 35 toward the lower frame 10. In FIGS. 4 and 5, the return members are gas cylinders 44, also known as gas springs, which are, on the one hand, fixed to the support 40 and, on the other hand, fixed to the upper clamp 34, 35. In an alternative embodiment, the gas cylinders 44 may be replaced with helical springs.

The vertical mobility of the upper clamps 34, 35 on their respective support 40, coupled with the presence of the aforementioned return members 44, allows said upper clamps 34, 35 to press the metal sheet 1 firmly against the lower clamps 36, 37 in an intermediate position of the upper frame 11, which position is depicted in FIG. 8, and then to compensate for the lowering of the upper frame 11 between its intermediate position and its bending position, depicted in FIG. 9. Furthermore, the clamping force clamping the upper clamps 34, 35 and lower clamps 36, 37 together is controlled, during the travel of the upper frame 11, between its intermediate position of contact and its bending position, by means of the return members 44.

Figure 6:
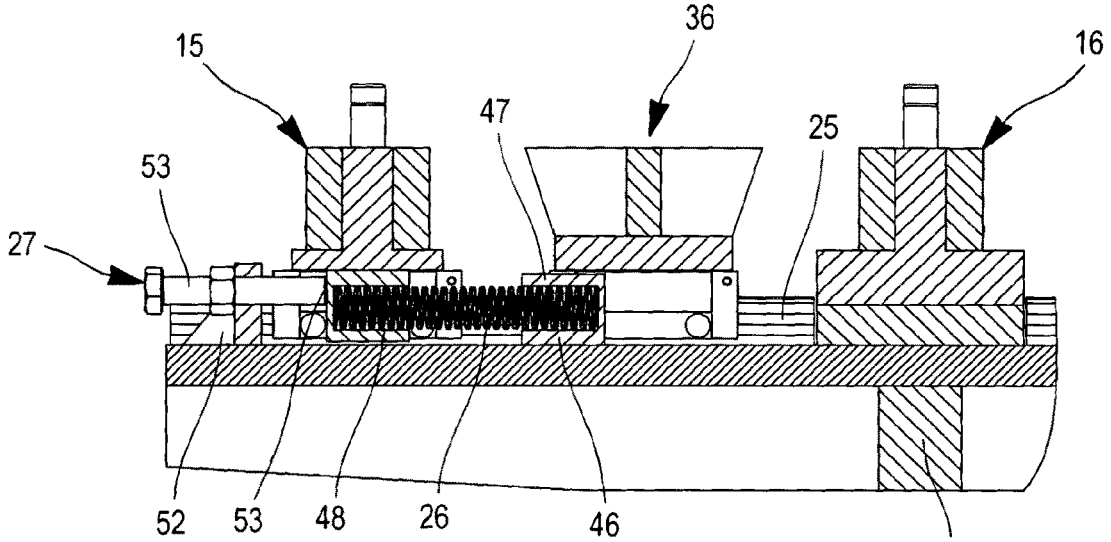
FIG. 6 is a partial view, in section on VI-VI of the device of FIG. 2, illustrating a return member for a lower clamp.
Figure 7:
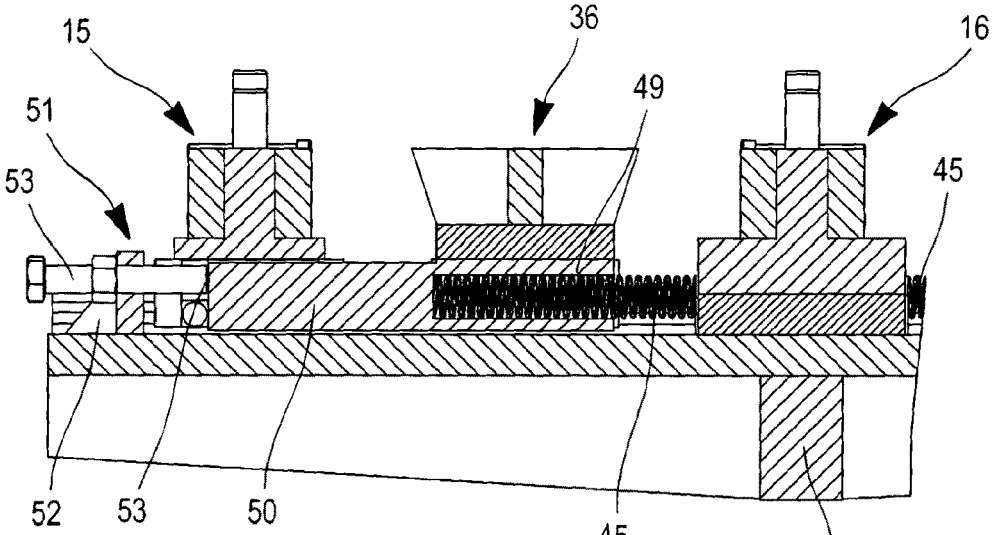
FIG. 7 is a partial view in section on VII-VII of the device of FIG. 2, illustrating a return member for a lateral die.

In relation to FIGS. 6 and 7 it may be seen that there are return members 26, 45 that allow one of the lateral dies 15 and one of the lower clamps 36 to be returned toward their spaced-apart position.

FIG. 6 illustrates a return member 26 that allows a lateral die 15 to be returned toward its position spaced apart from the central die 16. The return member 26 here is a helical spring which comprises a first end bearing against a bearing element 46, fixed to the lower frame 10, and a second end bearing against the lateral die 15. The bearing element 46 and the lateral die 15 each have a blind hole 47, 48 able to house the ends of the spring. According to one embodiment of the invention, each lateral die 15 is returned toward its spaced-apart position by a plurality of return members, arranged in this way. Moreover, each lateral die 15 collaborates with one or more end-stop elements 27 arranged along the lateral edges of the lower frame 10, so as to limit the travel of the lateral die 15 with respect to the lower frame 10.

FIG. 7 illustrates a return member 45 that allows a lower clamp 36 to be returned toward its position spaced apart from the central die 16. The return member 46 is a helical spring which has a first end bearing against an element that is fixed with respect to the lower frame 10, in this instance a lower portion of the central die 16, and a second end bearing against the lower clamp 36. The helical spring is partially housed in a blind hole 49 formed in the lower clamp 36. According to one embodiment, each lower clamp 36 is returned toward its spaced-apart position by a plurality of return members so arranged.

Moreover, the lower clamp 36 comprises several lateral lugs 50 projecting laterally toward the outside of the lower frame 10 and passing between the lower frame 10 and the adjacent lateral die 15 so as to allow said lateral lugs 50 to come into abutment against the end-stop elements 51 arranged along the lateral edges of the lower frame 10 when the lower clamp 36 is in its spaced-apart position.

Advantageously, the position of the end-stop elements 23, 51 that are able to limit the travel of the lateral dies 15 and lower clamps 36 is adjustable so as to allow the transverse distance between the corrugations that are to be formed to be adjusted. Thus, in the embodiment depicted in FIGS. 6 and 7, each end-stop element 27, 51 comprises a flange 52 fixed to the lower frame 10, complete with threaded bore, and a threaded screw 52, collaborating with the threaded bore and the end 53 of which constitutes the end-stop surface.

Let us note that the return members, not depicted, for the lateral punches 12, 14 and the upper clamps 34, 35, are arranged in almost the same way as the return members 26, 45 illustrated in FIGS. 6 and 7. Likewise, the end-stop elements 23 that make it possible to limit the travel of the lateral punches 12, 14 and of the upper clamps 34, 35 have an identical structure to the end-stop elements 27, 51.

We might also note that, according to an alternative embodiment which has not been depicted, the return members 26, 45 of the lateral dies 15, 17, of the clamps 34, 35, 36, 37 and/or of the lateral punches 12, 14 are gas cylinder actuators.

The operation of the bending device will now be described.

First of all, as depicted in FIG. 3, the metal sheet 1 is set in place while the upper frame 11 is in its rest position. The metal sheet 1 rests against the bearing surfaces of the lower clamps 36, 37, against the horizontal upper bearing surfaces 31, 32 of the lateral elements 28, 29 of the dies 15, 16, 17 and against the upper end of the central element 30 of the dies 15, 16, 17. The lateral punches 12, 14, the lateral dies 15, 17 and the upper 34, 35 and lower 36, 37 clamps are positioned in their spaced-apart position.

The upper frame 11 is then moved toward its bending position as far as an intermediate position, illustrated in FIG. 8, in which the upper clamps 34, 35 are pressing the metal sheet 1 firmly against the bearing surfaces of the lower clamps 36, 37. The punches 12, 13, 14 also come into contact with the metal sheet 1.

During the movement of the upper frame 11 from its intermediate position into its bending position, the metal sheet 1 is gripped between each punch 12, 13, 14 and the central element 30 of the die 15, 16, 17 opposite. As a result, when the punches 12, 13, 14 apply a forming load to the metal sheet 1, the central elements 30 of the dies 15, 16, 17 slide downward between the two lateral elements 28, 29 of their respective die, in the direction of their lowered position.

Moreover, the metal sheet 1, by deforming under the effect of the punches 12, 13, 14, applies a pulling force to the clamps 34, 35, 36, 37, to the lateral punches 12, 14 and to the lateral dies 15, 17 so that these move toward their close-together position.

When the upper frame 11 is in its bending position, at the end of travel, depicted in FIG. 9, the lateral dies 15, 17, the lateral punches 12, 14 and the clamps 34, 35, 36, 37 are situated in their close-together position and the central elements 30 of the dies 15, 16, 17 are situated in their lowered position.

Thereafter, the upper frame 11 is raised back up toward its rest position in order to release the corrugated metal sheet 1. As a result, the lateral dies 15, 17, the lateral punches 12, 14 and the clamps 34, 35, 36, 37 return directly to their spaced-apart position under the effect of the return members 26, 45 and the central elements 30 of the dies 15, 16, 17 return to their raised position under the effect of the return member 33.

Thus, such a bending device 9 makes it possible simultaneously to form several corrugations in a metal sheet, in a single stroke of the press, and to do so without altering the thickness of the metal sheet 1.

A punch 54 according to an alternative form of embodiment can be seen in relation to FIG. 10. A bending device 9 for simultaneously forming several corrugations as described hereinabove can be equipped with such punches 54. However, such a punch 54 is also able to be fitted to other bending devices and notably to bending devices that allow only one corrugation to be produced at a time.

The punch 54 has a head 57 which comprises an alternation of first portions 55 and of second portions 56. The first portions 55 and the second portions 56 are aligned in the longitudinal direction of the corrugation that is to be formed and are arranged alternately in said longitudinal direction. The two longitudinal ends of the head 57 are formed by first portions 55.

FIGS. 11 and 12 respectively show the cross section of a first portion 55 and the cross section of a second portion 56. In the case of the first and that of the second portions, the cross section is V-shaped this shape being defined by two lateral faces 55*a*, 55*b*, 56*a*, 56*b* that meet at a crest zone 55*c*, 56*c*. As in the previous embodiment, the head also comprises two lateral shoulders 19, 20 bordering the V-shaped section and extending out horizontally.

The first portions 55 are substantially semielliptical in shape. The two lateral portions 55*a*, 55*b* are therefore arched. This shape of the first portions corresponds to the definitive shape that is to be given to the tall corrugations 3 in the zones A separating two successive node zones (see FIG. 13). Such a shape allows the membrane 1 to be given excellent mechanical integrity properties.

The second portions 56 are substantially triangular in shape. In other words, their cross section is defined by two substantially planar lateral faces 56*a*, 56*b* meeting at a crest zone 56*c*. The crest zone 56*c* has a fillet radius. The transverse dimension of the cross section of the second portions 56 is substantially equal to that of the first portions 55. As depicted in FIG. 10, the crest zones 56*c* of the second portions 56 extend downward beyond the crest zone 55*c* of the first portions 55.

The geometry of the first portions allows the tall corrugation 3 to be formed in the zones B intended to constitute the node zones 5 at each intersection between a low corrugation 2 and a tall corrugation 3 when the low corrugations 2 have been formed later. The geometry of the second portions 56 is particularly well suited to giving the tall corrugation 3 a geometry that allows it thereafter to be bent in a direction perpendicular to its longitudinal direction thus making it possible to form the low corrugations and the node zones 5 comprising concave corrugations 7 and indentations 8.

Moreover, advantageously, the die, not depicted, intended to receive such a punch 54 as the upper frame 11 moves towards its bending position has a geometry that is adapted accordingly. In other words, such a die also comprises an alternation of first portions of a shape that complements that of the first portions 55 of the head of the punch and of second portions that have a shape that complements that of the second portions 57 of the head of the punch.

Such an arrangement of punch and die having an alternation of portions of different shapes means that during one and the same bending step:

the tall corrugations 3 can be shaped, which means to say given their definitive shape, in the zones that are not intended to be reworked later when forming a node zone, and they can be given a shape that allows the node zone to be formed later in the zones which will be bent again during a subsequent bending step.

This arrangement therefore makes it possible to limit the number of bending steps needed to form a metal sheet that has two perpendicular series of corrugations.

In some embodiments which have not been illustrated, each second portion 56 of the head is separated from the adjacent first portions 55 by a longitudinal transition portion. The length of the longitudinal transition portion is typically comprised between a few millimeters and 2 centimeters.

According to a first alternative form of embodiment, the longitudinal transition portions are free spaces, which means to say gaps between the first and second portions 55, 56 in which the head has no surfaces liable to come into contact with the metal sheet during the bending operation. In this alternative form of embodiment, the die intended to take such a punch comprises corresponding longitudinal portions formed of empty space between each of its adjacent second portions and first portions.

According to a second alternative form of embodiment, the longitudinal transition portions have a V-shaped cross section and comprise two lateral faces meeting at a crest zone. However, in these longitudinal transition portions, the head does not have a uniform cross section. Specifically, the lines of each of the lateral walls and of the crest zone which have a longitudinal component are inclined with respect to the longitudinal direction so that the transition between the first and second portions is one with a shallow slope. In this alternative form of embodiment, the die intended to take such a punch comprises longitudinal portions with a shape corresponding to that of the longitudinal transition portions of the head between each of the second portions thereof and the adjacent first portions.

Figure 14:
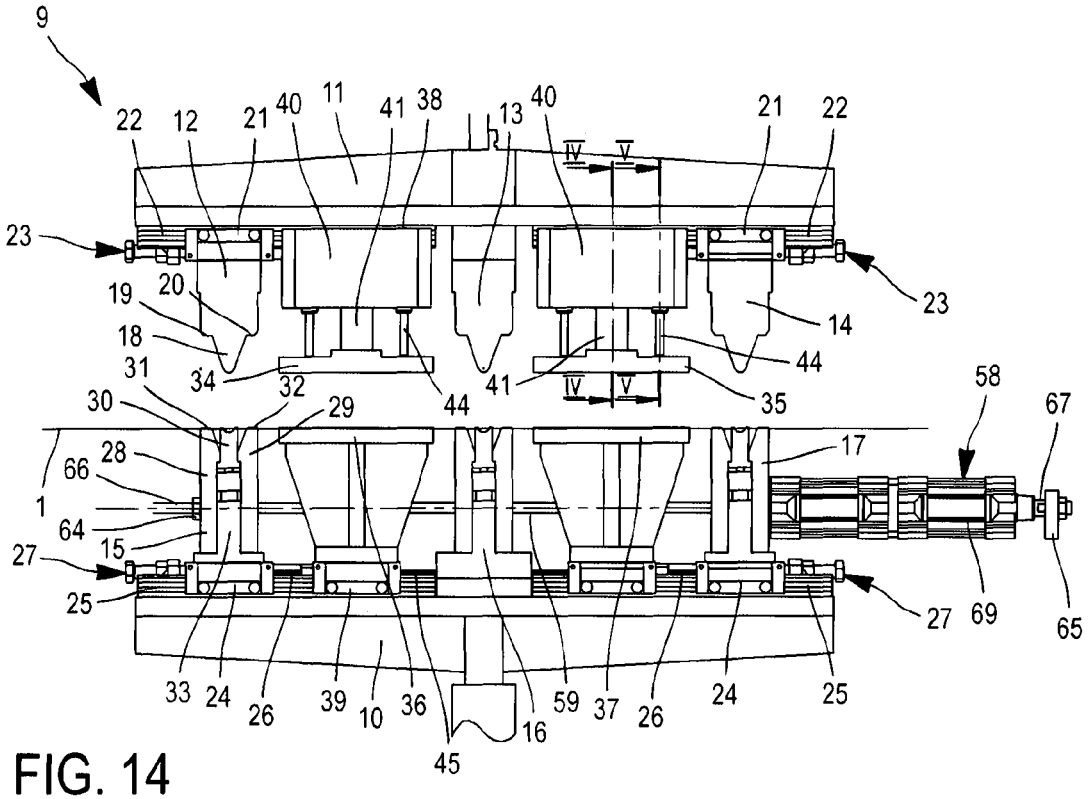
FIG. 14 is a front view of a bending device according to a second embodiment.
Figure 15:
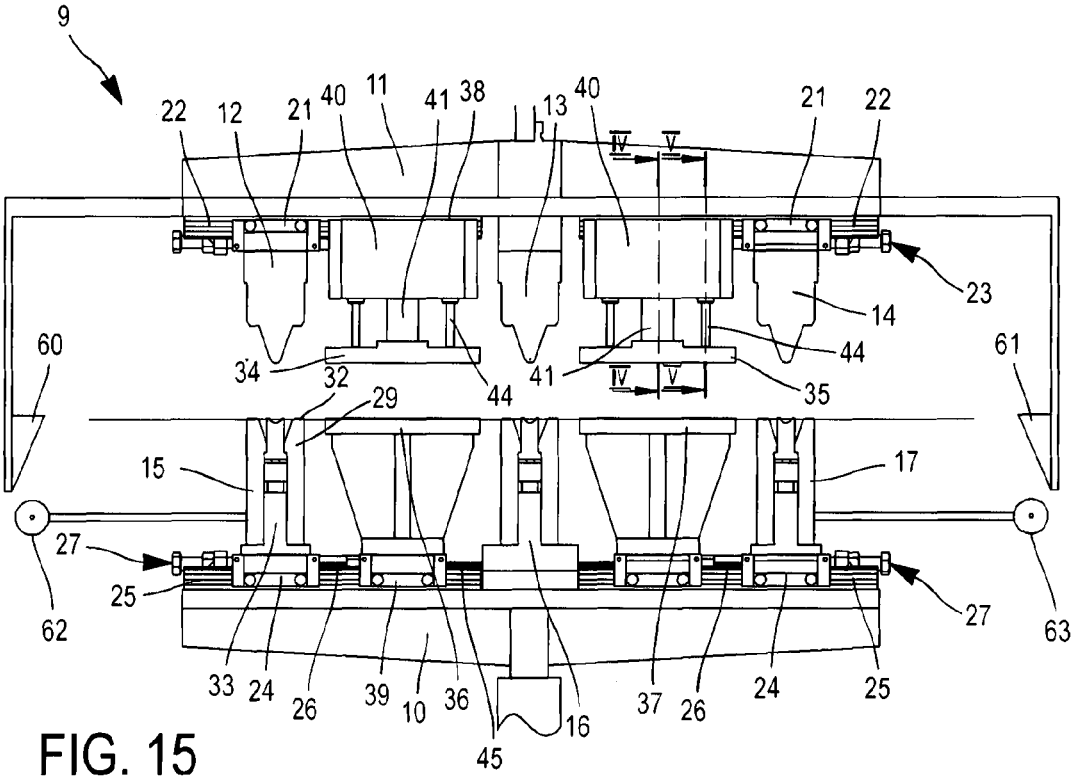
FIG. 15 is a front view of a bending device according to a third embodiment.

In the embodiments depicted in FIGS. 14 and 15, the bending device is equipped with assistance means assisting the movement of the lateral punches 12, 14 and of the lateral dies 15, 17 towards their close-together position. In other embodiments, the bending device may further comprise assistance means assisting with the movement of the upper clamps 34, 35 and of the lower clamps 36, 37 toward their close-together position. Such assistance means are particularly advantageous in that they notably make it possible to guarantee that the lateral punches 12, 14 and the lateral dies 15, 17 and optionally the upper 34, 35 and lower 36, 37 clamps, move over their entire travel, namely all the way to their close-together final position, as the upper frame 11 moves towards its bending position.

In the embodiment depicted in FIG. 14, the assistance means comprise one or more actuating cylinders 58, such as pneumatic actuating cylinders for example, able to assist the movement of the lateral dies 15, 17 from their spaced-apart position toward their close-together position.

In the embodiment depicted, each actuating cylinder 58 comprises a body 69 which is fixed to the lateral die 17 and a rod 59 which passes through the three dies 15, 16, 17 and the lower clamps 36, 37. One of the ends 64 of the rod 59 collaborates with a nut 64 which is mounted on said end 64 and is able to collaborate with the other lateral die 15 so as to move it into its close-together position when the rod 59 moves with respect to the body 69 of the actuating cylinder.

Each actuating cylinder 58 is thus able to apply to the two lateral dies 15, 17 a force that tends to move them closer toward one another. In other words, each actuating cylinder 58 is therefore able to assist with the moving of the lateral dies 15, 17 from their spaced-apart position toward their close-together position.

The rod 59 of each actuating cylinder 58 passes through the body 69 of said actuating cylinder in such a way that the two ends 66, 67 of the rod extend respectively one on each side of the body 69. Thus, when the bending device comprises a plurality of actuating cylinders, as in FIG. 14, the second ends 67 of the actuating cylinders 58 are joined together by an intermediate plate 65 so as to allow the movement of the actuating cylinders 58 to be synchronized.

Alternatively, according to another embodiment which has not been depicted, it is also possible to use a first series of actuating cylinders which are each, on the one hand, fixed to the lower frame 10 and, on the other hand, fixed to one or other of the lateral dies 15, 17 and which thus allow the application of an assistance force that has a tendency to move the lateral dies 15, 17 toward their close-together position by bearing against the lower frame 10.

Moreover, according to other embodiments, the assistance means as an alternative or in addition to the aforementioned actuating cylinders, comprise one or more pneumatic actuating cylinders, not depicted, which collaborate with each of the two lateral punches 12, 14 in order to assist with moving them from their spaced-apart position toward their close-together position.

According to other embodiments, in addition to the aforementioned actuating cylinders, the bending device further comprises one or more additional actuating cylinders, not depicted, which respectively collaborate with each of the two lower clamps 36, 37 or with each of the upper clamps 34, 35.

In the embodiment illustrated in FIG. 15, the assistance means comprise two cams 60, 61 each collaborating with a cam follower 62, 63. Each lateral die 15, 17 is equipped with a cam follower 62, 63 designed to collaborate with a respective cam surface 60, 61 borne by the upper frame 11 as the latter moves downward, from its rest position towards its bending position. The cam followers 62, 63 are advantageously rollers mounted freely about a horizontal axis parallel to the direction of the corrugations that are to be formed. The cam surfaces 60, 61 are oriented in such a way that as the upper frame 11 moves from its rest position toward its bending position, the cam surface 60, 61 applies pressure to the cam follower 62, 63 that has a tendency to move the lateral dies 15, 17 toward their close-together position.

According to one embodiment, the cams 60, 61 and cam followers 62, 63 are arranged in such a way that they do not come into operation as soon as the punches 12, 13, 14 come into contact with the portion of the metal sheet that is to be bent but later as the punches 12, 13, 14 move toward their final bending position. The cams 60, 61 can also be arranged in such a way that the cam followers do not come into contact with the cams 60, 61 so as to assist with the movement of the lateral dies 15, 17 except in the scenario in which the dynamics of said lateral dies 15, 17 is slightly delayed in relation to the desired dynamics.

According to an alternative embodiment which has not been illustrated, the cams 60, 61 and cam followers 62, 63 act between the lower frame 10 and the lateral punches 12, 14. Thus, each lateral punch 12, 14 is equipped with a cam follower or with a cam which is suited to collaborating with a cam or with a cam follower borne by the lower frame 10 when the upper frame 11 moves downward toward its bending position.

Moreover, according to other embodiments, the bending device further comprises, in addition to the aforementioned cams and cam followers, cam and cam follower assistance means which allow the movement of the two lower clamps 36, 37 and of the two upper clamps 34, 35 toward their close-together position to be assisted. To do that, each of the upper clamps 34, 35 or each of the lower clamps 36, 37 comprises a cam or a cam follower which collaborates with a cam follower or a cam borne by the upper 11 or lower 10 frame.

The use of the verbs "comprise", "have" or "include" and of the conjugated forms thereof does not exclude the presence of elements or steps other than those mentioned in a claim. The use of the indefinite article "a" or "an" for an element or step does not, unless mentioned otherwise, exclude there being a plurality of such elements or steps.

In the claims, any reference sign between parentheses must not be interpreted as a limitation on the claim.

The invention claimed is:

1. A bending device for simultaneously forming at least two parallel corrugations in a metal sheet, the bending device comprising:

a lower frame having at least two longitudinal parallel axes;

an upper frame mounted and configured to move vertically with respect to the lower frame between a rest position and a bending position;

at least first and second dies borne by the lower frame and each comprising a cavity which extends along one of the two longitudinal parallel axes and has a shape for forming one of the corrugations; the first die being fixed with respect to the lower frame and the second die being mounted and configured to slide on the lower frame in a direction transverse to the two longitudinal parallel axes, between a spaced-apart position and a close-together position with respect to the first die; said second die being returned towards its spaced-apart position by a return member;

at least a first and a second punches which are parallel and carried by the upper frame respectively above the first and above the second dies, the first punch being fixed with respect to the upper frame and intended to engage inside the cavity of the first die when the upper frame moves from its rest position towards its bending position so as to press the metal sheet, and the second punch being mounted and configured to slide on the upper frame in a direction transverse to the two longitudinal parallel axes, between a spaced-apart position and a close-together position with respect to the first punch and being intended to engage inside the cavity of the second die when the upper frame moves towards its bending position so as to press the metal sheet, said second punch being returned towards its spaced-apart position by a return member;

the bending device being configured to cause the metal sheet to be bent between the first punch and the first die and between the second punch and the second die, so that said metal sheet transmits a pulling force to the second punch and to the second die which moves the second punch and the second die from their respective spaced-apart position toward their respective close-together position when the upper frame moves towards its bending position.

2. The bending device as claimed in claim 1, in which the first and second dies each comprise two lateral elements and a central element; the lateral elements each comprising a lateral portion of the cavity of said first or second die and the central element comprising a central portion of the cavity of said first or second die, the central element being mounted and configured to move vertically, between the lateral elements, between a raised position and a lowered position and being returned toward its raised position by a return member such that, in operation, the movement of the upper frame from its rest position toward its bending position is able to grip the metal sheet between each of the first and second punches and the central element of the corresponding first or second die and to move the central element from its raised position to its lowered position.

3. The bending device as claimed in claim 2, in which the return member for the central element is a gas spring or a helical spring.

4. The bending device as claimed in claim 2, in which the lateral elements of the first and second dies each comprise a horizontal upper bearing surface which is intended to receive the metal sheet and in which the first and second punches each have a head comprising a V-shaped portion of a shape that complements that of the cavity of the first or of the second die and two shoulders bordering the V-shaped portion, extending out horizontally and each coming to face the horizontal upper bearing surface of one of the lateral elements of the first or of the second die.

5. The bending device as claimed in claim 1, further comprising:

a first lower clamp, mounted on the lower frame between the first and the second dies and having a bearing surface intended to receive the metal sheet; the first lower clamp being mounted and configured to slide on the lower frame in a direction transverse to the two longitudinal parallel axes between a spaced-apart position and a close-together position with respect to the first die, the first lower clamp being returned towards its spaced-apart position by a return member;

a first upper clamp, mounted on the upper frame between the first and second punches above the first lower clamp so as to allow the metal sheet to be clamped between the first upper clamp and the first lower clamp as the upper frame moves from its rest position towards its bending position, the first upper clamp being mounted and configured to slide on the upper frame in a direction transverse to the two longitudinal parallel axes between a spaced-apart position and a close-together position with respect to the first punch, and returned towards its spaced-apart position by a return member;

the bending device being arranged such that, in operation, the movement of the upper frame from its rest position toward its bending position causes the metal sheet to be bent between the first punch and the first die such that said metal sheet transmits a pulling force to the first upper clamp and to the first lower clamp, which moves the first upper and lower clamps from their respective spaced-apart position toward their respective close-together position.

6. The bending device as claimed in claim 5, in which the first upper clamp is mounted and configured to move vertically on a support mounted and configured to slide on the upper frame in the direction transverse to the two longitudinal parallel axes and in which the first upper clamp is returned to a distance away from said support by a series of return members.

7. The bending device as claimed in claim 6, in which the first upper clamp is mounted and configured to slide vertically on the associated support via guide tubes borne by the first upper clamp and sliding in bores formed in the support.

8. The bending device as claimed in claim 6, in which the return member returning the first upper clamp to some distance away from the support is a gas spring or a helical spring.

9. The bending device as claimed in any one of claim 1, further comprising:

a third die comprising a cavity having a shape for forming one of the corrugations, parallel to the cavities of the first and second dies; the first die being arranged between the second and the third dies, the third die being mounted and configured to slide on the lower frame in a direction transverse to the two longitudinal parallel axes between a spaced-apart position and a close-together position with respect to the first die, said third die being returned to its close-together position by a return member; and a third punch, parallel to the first and second punches, borne by the upper frame above the third die; the third punch being configured to engage inside the third die when the upper frame is moving from its rest position into its bending position and being mounted and configured to slide on the upper frame transversely to the two longitudinal parallel axes between a spaced-apart position and a close-together position with respect to the first punch, said third punch being returned to its spaced-apart position by a return member.

10. The bending device as claimed in claim 9, further comprising:

a second lower clamp, mounted on the lower frame between the first and third dies and having a bearing surface intended to accept the metal sheet; the second lower clamp being mounted and configured to slide on the lower frame in a direction transverse to the two longitudinal parallel axes between a spaced-apart position and a close-together position with respect to the first die, the second lower clamp being returned towards its spaced-apart position by a return member;

a second upper clamp, mounted on the upper frame between the first and the third punches above the second lower clamp, so as to clamp the metal sheet between the second upper clamp and the second lower clamp during the movement of the upper frame from its rest position towards its bending position, the second upper clamp being mounted and configured to slide on the upper frame in a direction transverse to the two longitudinal parallel axes between a spaced-apart position and a close-together position with respect to the first punch and returned towards its spaced-apart position by a return member;

the bending device being configured to cause the metal sheet to be bent between the first punch and the first die in such a way that said metal sheet transmits a pulling force to the second upper clamp and to the second lower clamp which moves the second upper and lower clamps from their respective spaced-apart position toward their respective close-together position when the upper frame moves from its rest position toward its bending position.

11. The device as claimed in claim 1, further comprising an assistance member configured to assist with the movement of the second die and of the second punch towards their close-together position.

12. The bending device as claimed in claim 11, in which the assistance member comprises an actuating cylinder cooperating with the second die or with the second punch and being configured to assist with the moving of the second die and of the second punch toward their close-together position as the upper frame moves from its rest position toward its bending position.

13. The bending device as claimed in claim 12, in which the assistance member comprises a cam follower and a cam, of the cam follower and the cam one being borne by the second die or the second punch and the other being borne by the upper frame or the lower frame such that when the upper frame moves from its rest position to its bending position the cam follower collaborates with the cam to assist with the movement of the second die and of the second punch toward their close-together position.

14. The device as claimed in claim 1, in which each of the first and second punches comprises a head comprising first and second portions of V-shaped cross section, the first and second portions being arranged alternately one after another, each of the first and second portions comprising two side walls meeting at a crest zone so as to define the V-shaped cross section; the lateral faces of the first portions being bowed with a convex face facing toward the first or the second die and the lateral faces of the second portions being planar.

15. A method of using a bending device as claimed in claim 1, the use involving: positioning a metal sheet against the first and second dies; and moving the upper frame from its rest position toward its bending position.

* * * * *